US007726713B2

(12) United States Patent
Oleksia

(10) Patent No.: US 7,726,713 B2
(45) Date of Patent: Jun. 1, 2010

(54) MULTI-USE TOOL FOR FIREFIGHTERS

(76) Inventor: Joseph A. Oleksia, 32 Jenkins Ct., Front Royal, VA (US) 22630

( * ) Notice: Subject to any disclaimer, the term of this patent is extended or adjusted under 35 U.S.C. 154(b) by 203 days.

(21) Appl. No.: 11/765,012

(22) Filed: Jun. 19, 2007

(65) Prior Publication Data

US 2008/0001419 A1 Jan. 3, 2008

Related U.S. Application Data

(60) Provisional application No. 60/806,008, filed on Jun. 28, 2006.

(51) Int. Cl.
*B66F 15/00* (2006.01)

(52) U.S. Cl. ..... 294/24; 294/26; 294/82.1; 254/131; 7/166

(58) Field of Classification Search ..... 294/10, 294/14, 24, 26, 82.1; 254/25, 120, 131; 7/161, 7/166

See application file for complete search history.

(56) References Cited

U.S. PATENT DOCUMENTS 481,763 A * 8/1892 Johnson ..... 140/102.5
886,987 A * 5/1908 Kiehle ..... 7/144
1,758,744 A * 5/1930 Haubert ..... 24/697.1
2,087,148 A * 7/1937 Hempy ..... 254/25
2,542,289 A * 2/1951 Robbins ..... 294/82.1
4,934,174 A * 6/1990 Gronlund et al. ..... 72/458
5,197,176 A * 3/1993 Reese ..... 29/278
5,315,724 A * 5/1994 Trujillo et al. ..... 7/145
6,113,074 A * 9/2000 Foley ..... 254/25
6,431,523 B2 * 8/2002 Goldman ..... 254/1
2007/0283503 A1 * 12/2007 Ryan ..... 7/166

* cited by examiner

*Primary Examiner*—Dean J Kramer
(74) *Attorney, Agent, or Firm*—Raymond Nuzzo

(57) ABSTRACT

A multi-use tool having a generally "J" shaped hook structure which has a top portion, a middle shank portion attached to the top portion, and a curved bottom portion attached to the middle shank portion. The top portion has a loop portion to which a rope, life-line or escape line can be fastened. The curved bottom portion extends to a beveled tip. The multi-use tool also has a protruding member that extends from the curved bottom portion and has a substantially flat top surface and a substantially flat bottom surface.

7 Claims, 4 Drawing Sheets

MULTI-USE TOOL FOR FIREFIGHTERS

CROSS-REFERENCE TO RELATED APPLICATIONS

This application claims the benefit of U.S. provisional patent application No. 60/806,008, filed Jun. 28, 2006. The entire disclosure of the aforesaid application No. 60/806,008 is hereby incorporated by reference.

BACKGROUND OF THE INVENTION (1) Field of the Invention

The present invention generally relates to a multi-use tool for use by a firefighter.

(2) The Problem to be Solved

It is common for firefighters to enter burning buildings and houses to rescue occupants and/or to extinguish the fire. Many times, firefighters will enter a room or area of the building through an entrance, but are unable to leave because the entrance has become engulfed in flames. A situation like this occurred in New York City. In that fire, five firemen were forced to jump from a fifth story window when fire engulfed the apartment within which they were located. Two of the firemen died upon hitting the ground and the other three firemen sustained life-threatening injuries.

What is needed is a multi-use tool that, in addition to performing other functions, enables trapped firemen to suspend themselves outside a window or other opening in a burning building until they are rescued or the fire is extinguished.

SUMMARY OF THE INVENTION

It is therefore a primary object and general purpose of the present invention to provide a new multi-use tool for use by firefighters.

To attain the objects of the present invention, a multi-use tool is provided that has a generally "J" shaped hook structure which has a top portion, a middle shank portion attached to the top portion, and a curved bottom portion attached to the middle shank portion. The top portion has a loop portion to which a rope, life-line or escape line can be fasten. The curved bottom portion extends to a beveled tip. The multi-use tool also has a protruding member that extends from the curved bottom portion and has a substantially flat top surface and a substantially flat bottom surface.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

DESCRIPTION OF THE PREFERRED EMBODIMENTS

Figure 1:
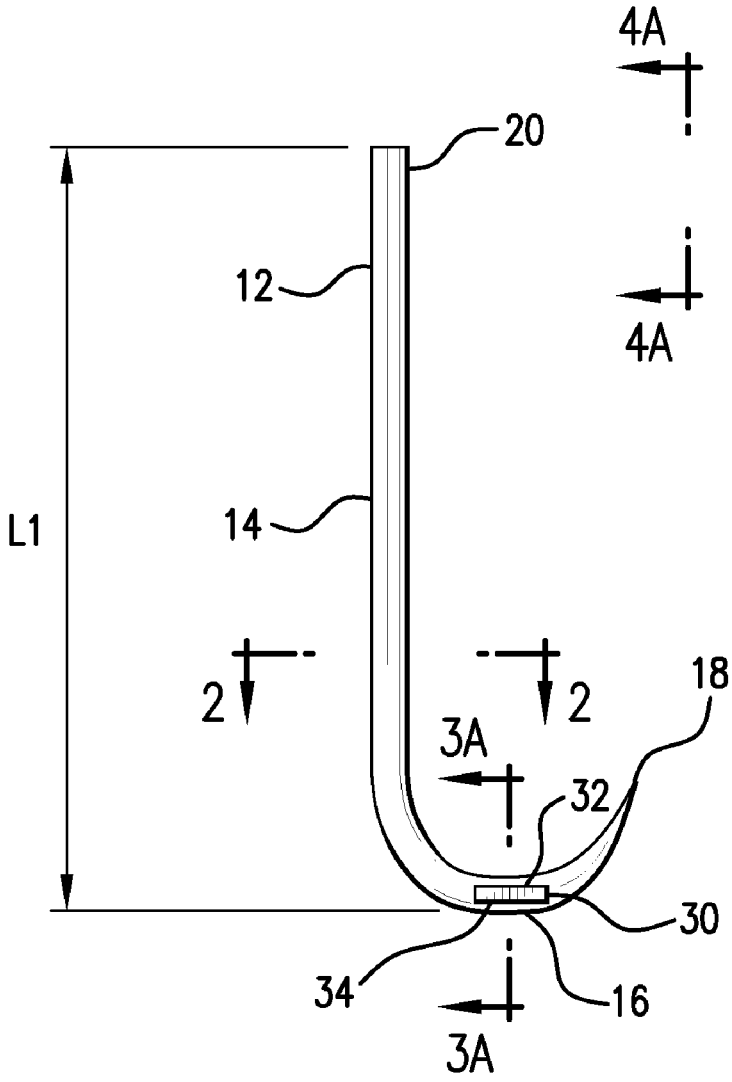
FIG. 1 is a side elevational view of a multi-use tool in accordance with one embodiment of the present invention.
Figure 2:
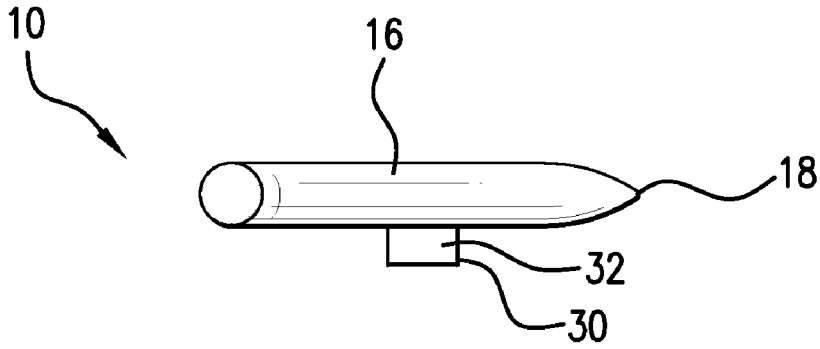
FIG. 2 is a view taken along line 2-2 of FIG. 1.

Referring now to the drawings in detail wherein like numerals indicate the elements throughout the several views, FIGS. 1-4A show multi-use tool 10 of the present invention. Multi-use tool 10 is configured to have the shape of a "J" shaped hook. Multi-use tool 10 comprises top portion 12, middle shank portion 14 and curved bottom portion 16. Curved bottom portion 16 extends to beveled tip 18. Top portion 12 comprises loop portion 20 that provides opening 22 (see FIG. 4A). A rope, wire, cable or escape line can be inserted through opening 22 and fastened to loop portion 20.

Referring to FIGS. 1-4A, tip 18 is beveled so that it can be easily forced between a door and its jamb, allowing the door to be pried open with minimal effort. In one embodiment, the length L1 of multi-use tool 10 is between 24 and 28 inches. More preferably, the length L1 is about 26 inches. In a preferred embodiment, top portion 12, middle shank portion 14 and bottom curved portion 16 (except beveled tip 18), each has a diameter between about 0.5 inch and 1.25 inches. Multi-use tool is fabricated from high-strength metal, such as forged steel, which can withstand high temperatures. Other suitable metals can be used to fabricate multi-use tool 10. Examples of other suitable metals are titanium and stainless steel. Preferably, the metal from which multi-use tool 10 is made has a degree of strength that allows at least 1000 pounds to be suspended from multi-use tool 10 without any deformation in the metal.

Figure 3A:
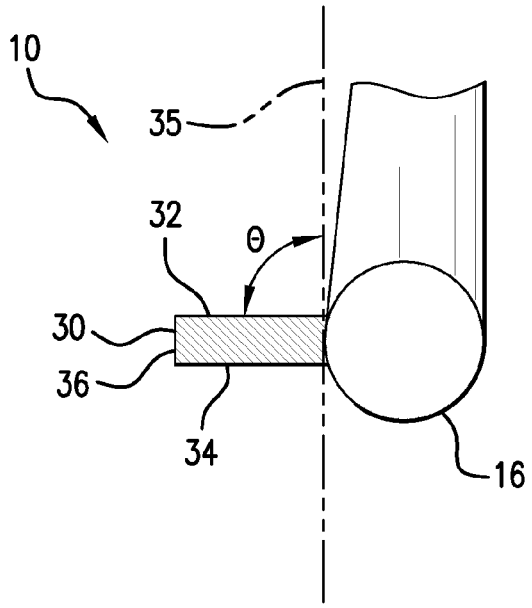
FIG. 3A is a view taken along line 3A-3A of FIG. 1.
Figure 3B:
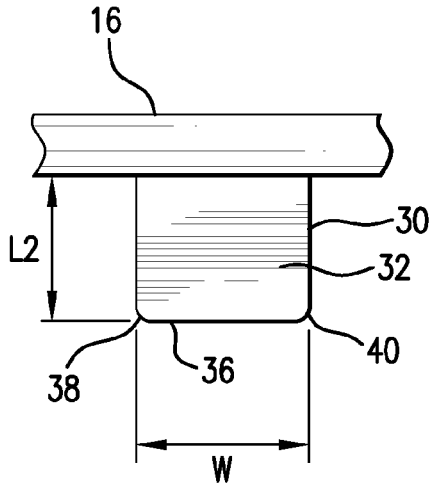
FIG. 3B is an enlarged view of a portion of the view of FIG. 2.

Referring to FIGS. 1, 2, 3A and 3B, multi-use tool 10 further comprises protruding member 30. In a preferred embodiment, protruding member 30 is made from the same metal from which the remaining portion of multi-use tool 10 is made. In one embodiment, protruding member 30 is welded to the side of curved bottom portion 16. In another embodiment, protruding member 30 is integral with the curved bottom portion 16. Protruding member 30 has top surface 32 and bottom surface 34. In a preferred embodiment, top and bottom surfaces 32 and 34 are substantially flat. In one embodiment, protruding member 30 has a length L2 of about 2.75 inches and width W of about 2.125 inches (see FIG. 3B). However, other dimensions are possible. Referring to FIG. 3A, in a preferred embodiment, protruding member 30 is substantially perpendicular to tangential reference line 35. Thus, preferably, the angle $\Theta$ is about 90°. Protruding member 30 has an edge 36 which has beveled portions 38 and 40.

Referring to FIGS. 1, 2, 3A and 3B, protruding member 30 is used to pry open doors, remove floor boards or dismantle other structures that may be impeding the progress of firefighters or rescue personnel. An important advantage of the structure and location of protruding member 30 is that it can be used to pry open a door when multi-use tool 10 cannot be properly positioned to allow beveled tip 18 to pry open the door. This situation can occur if the door is at the end of a long hallway and there are walls on either side of the door. This is illustrated in FIG. 8 wherein firefighters will need to break down door 60 which is located at the end of a long hallway.

Figure 8:
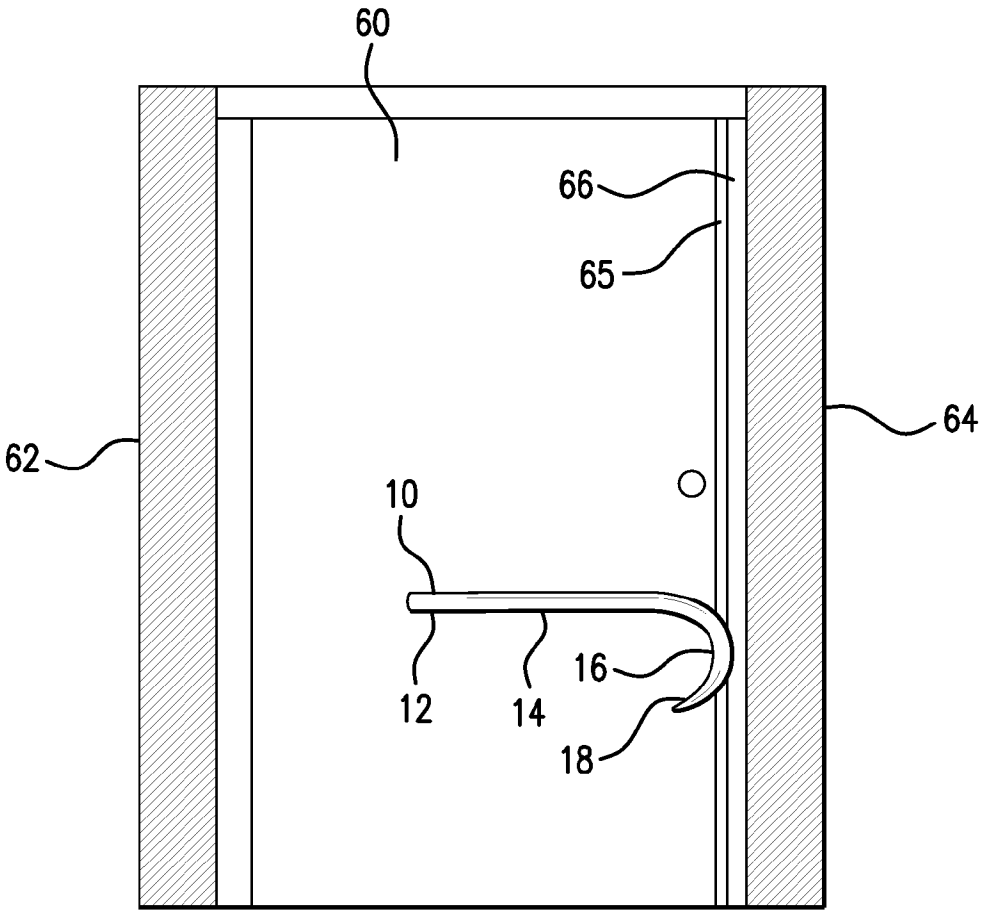
FIG. 8 is a diagram that illustrates another use of the multi-use tool of the present invention.

The view of FIG. 8 is that of looking down the hallway. Wall 62 is on one side of the hallway and wall 64 is on the other side of the hallway. Walls 62 and 64 are shown in cross-section. It would be difficult to use beveled tip 18 due to the proximity of walls 62 and 64. Specifically, the proximity of walls 62 and wall 64 would prevent the particular angular movement of curved bottom portion 16 that would be needed in order to pry open door 60. In this situation, the firefighter would then position multi-use tool 10 across door 60 in a generally horizontal orientation so that protruding member 30 is aligned with the slight space or crack 65 between door 60 and door jam 66. The firefighter then pushes on multi-use tool 10 so that protruding member 30 is inserted into space or crack 65. The firefighter then pulls top portion 12 outward so that multi-use tool 10 pivots outward about the point where protruding member 30 is inserted into crack or space 65. This motion causes protruding member 30 to pry open door 60.

Figure 4A:
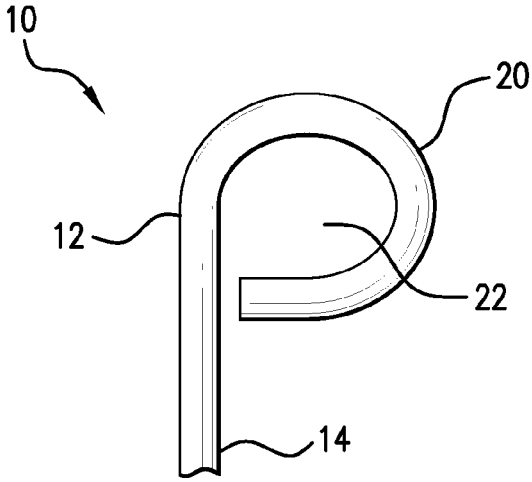
FIG. 4A is a view taken along line 4A-4A of FIG. 1.
Figure 4B:
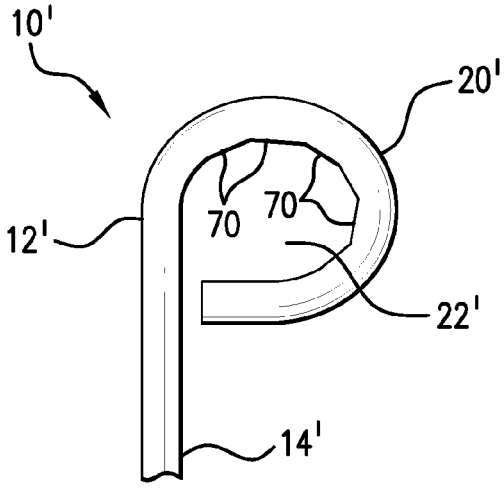
FIG. 4B is a view, similar to FIG. 4A, which shows a loop portion in accordance with another embodiment of the present invention.

Referring to FIG. 4A, loop portion 20 is shaped so that space 22 is sized to receive a standard gas-meter shut-off valve. This allows the firefighter to shut off the natural gas to a home or building. Another embodiment of loop 20 is shown in FIG. 4B. Multi-use tool 10' comprises top portion 12' and middle shank portion 14' which are similar to top portion 12 and middle shank portion 14, respectively, of multi-use tool 10. Top portion 12' includes loop 20' which has opening 22'. Loop 20' has a series of inner flat surfaces 70 that are configured to grasp the flat surfaces (typically arranged in a hexagonal or octagonal configuration) of a shut-off valve.

Figure 6:
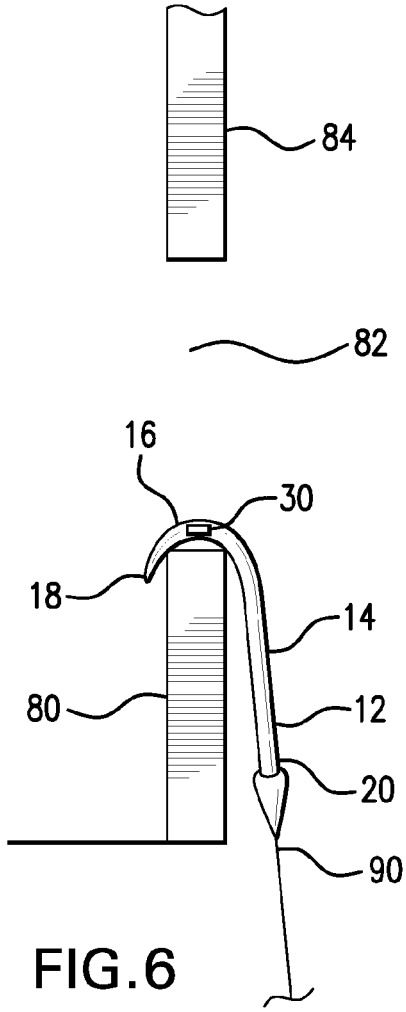
FIG. 6 is a diagram that illustrates one use of the multi-use tool of the present invention.

If a firefighter is searching a room and becomes trapped by fire and cannot leave the room by the same way he entered, the firefighter can use multi-use tool 10 to suspend himself or herself outside any window. This is illustrated in FIG. 6. The firefighter positions multi-use tool 10 so that curved portion 16 is hooked over wall section 80 that is below opening 82 that is created by breaking, opening or removing the window. Wall section 84 is above opening 82. The firefighter can then fasten one end of life-line or escape line 90 to loop portion 20 and the other end to himself or herself. The firefighter can then maneuver himself or herself outside of the window and then suspend himself or herself with the line 90 (the firefighter is not shown in FIG. 6). If a life-line or escape-line is not available, the firefighter can use the straps that are part of his or hers self-contained breathing apparatus (SCBA). The firefighter can then fasten the straps to loop 20 and himself or herself. As long as wall 80 remains intact, the firefighter can simply hang outside next to the exterior of the building or structure waiting to be rescued from below, or for the fire in the room to be extinguished so the firefighter can re-enter the room.

Figure 7:
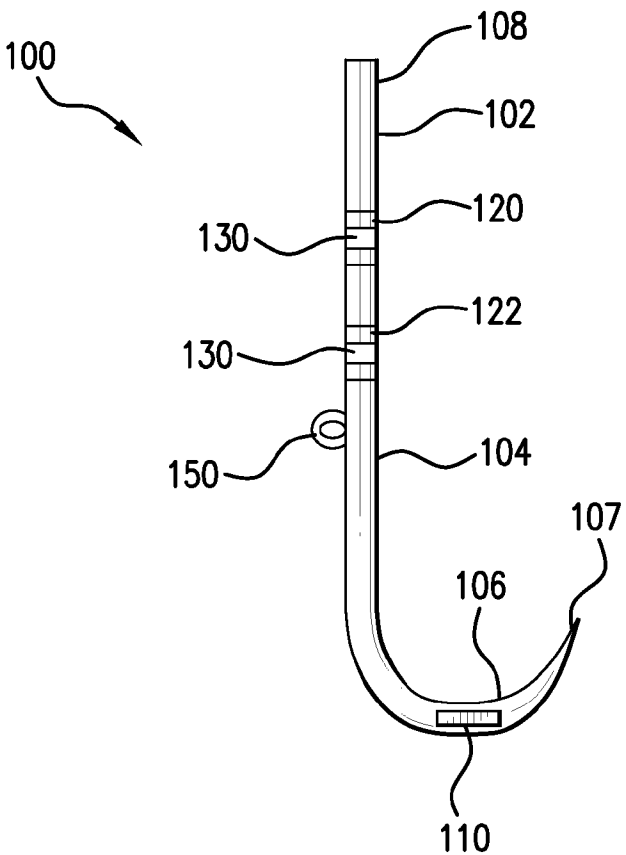
FIG. 7 is a side elevational view of a multi-use tool in accordance with a further embodiment of the present invention.

Referring to FIG. 7, there is shown multi-use tool 100 in accordance with another embodiment of the present invention. Multi-use tool 100 generally comprises top portion 102, middle shank portion 104 and curved bottom portion 106. Curved bottom portion 106 extends to beveled tip 107. Top portion 102 includes loop portion 108. Protruding member 110 extends from the side of curved portion 106. Top portion 102, middle shank portion 104 and curved portion 106 have the same structure and function as top portion 12, middle shank portion 14 and curved portion 16, respectively, of multi-use tool 10. Similarly, beveled tip 107 and protruding member 110 have the same structure and function as beveled tip 18 and protruding member 30, respectively, of multi-use tool 10. Multi-use tool 100 further includes hand grips 120 and 122 which are attached to middle shank portion 104. Hand grips 120 and 122 are made from a material that can withstand relatively high temperature. One example of a suitable material is Kevlar®. Fastening members 130, such as screws or rivets, can be used to attach hand grips 120 and 122 to middle shank portion 104. Multi-use tool 100 further comprises eye loop 150 that is attached to middle shank portion 104. Eye loop 150 is made from the same material from which multi-use tool 100 is fabricated. In one embodiment, eye loop 150 is welded to middle shank portion 104. In another embodiment, eye loop 150 is integral with the remaining portion of multi-use tool 100. Eye loop 150 enables a firefighter, when he or she is using multi-use tool 100 to suspend himself or herself outside of a window, to secure a separate line to eye loop 150 that holds the firefighter's supplies or equipment, such as a first aid box, so these items will not be destroyed by the fire.

Figure 5:
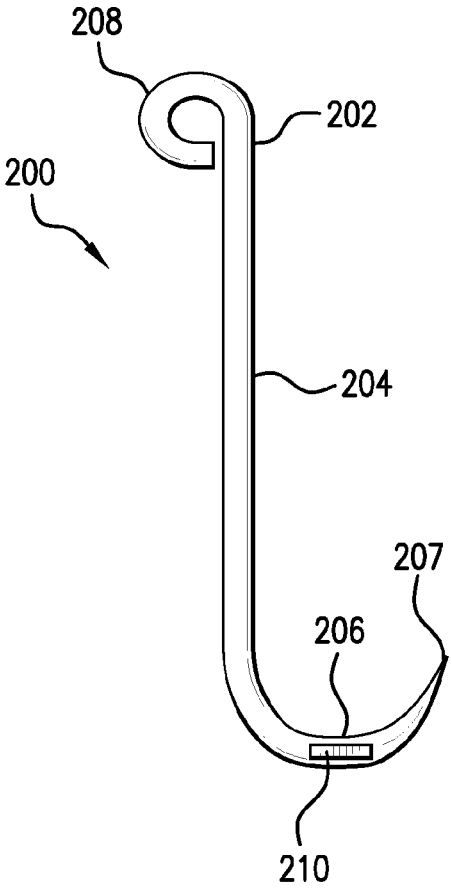
FIG. 5 is a side view of a multi-use tool in accordance with another embodiment of the present invention.

Referring to FIG. 5, there is shown a multi-use tool 200 in accordance with a further embodiment of the present invention. Multi-use tool 200 generally comprises top portion 202, middle shank portion 204 and curved bottom portion 206. Curved bottom portion 206 has beveled tip 207. Top portion 202 includes loop portion 208. Protruding member 210 extends from the side of curved bottom portion 206. Multi-use tool 200 has generally the same structure as multi-use tool 100 except that loop portion 208 is oriented differently in comparison to loop portion 20 of multi-use tool 10. Specifically, loop portion 208 is oriented about 90° from the original orientation of loop portion 20 of multi-use tool 10 (see FIG. 1).

Thus, the multi-use tool of the present invention provides the following advantages, benefits and features:

a) it is small enough to be carried by a firefighter or first responder;
b) it can be used as a forcible entry tool;
c) it can be used to open doors in narrow hallways;
d) it can be used to pry up floor boards or other structures that may be in the way of firefighters;
e) it has a loop that is configured to close shut-off valves on natural gas lines; and
f) it is strong enough to allow a firefighter to suspend himself or herself outside a window or other opening of a burning building until he or she can be rescued.

The foregoing description of the preferred embodiments of the invention has been presented for purposes of illustration and description only. It is neither intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A multi-use tool comprising:

an elongate shank having a first end and a second end;

a loop portion attached to said first end of said elongate shank, said loop portion lying in a first plane and defining a central opening, said loop portion having an inner surface that extends about said central opening, wherein said inner surface comprises a series of substantially flat portions for contacting corresponding flat surfaces of a shut-off valve;

a hook portion attached to said second end of said elongate shank, said hook portion extending to a beveled tip and lying in a second plane that is substantially orthogonal to said first plane; and a protruding member attached to a portion of said hook portion that is between said beveled tip and said second end of said elongate shank, said protruding member extending in a direction that is substantially orthogonal to said second plane, said protruding member having a substantially flat top surface and a substantially flat bottom surface.

2. The multi-use tool according to claim 1 wherein the protruding member has beveled corners.

3. The multi-use tool according to claim 1 further comprising at least one hand grip attached to said elongate shank.

4. The multi-use tool according to claim 1 wherein the multi-use tool is fabricated from a material chosen from the group consisting of forged steel, stainless steel and titanium.

5. The multi-use tool according to claim 1 further comprising an eye loop attached to said elongate shank, said eye loop being sized to receive a rope or line.

6. A multi-use tool comprising:

an elongate shank having a first end and a second end;

a hand grip attached to said elongate shank;

an eye loop attached to said elongate shank for receiving a rope or line;

a loop portion attached to said first end of said elongate shank, said loop portion lying in a first plane and defining a central opening, said loop portion having an inner surface that extends about said central opening and which comprises a series of substantially flat portions for contacting corresponding flat surfaces of a shut-off valve;

a hook portion attached to said second end of said elongate shank, said hook portion extending to a beveled tip and lying in a second plane that is substantially orthogonal to said first plane; and a protruding member attached to a portion of said hook portion that is between said beveled tip and said second end of said elongate shank, said protruding member extending in a direction that is substantially orthogonal to said second plane, said protruding member having substantially flat top and bottom surfaces and beveled corners.

7. A multi-use tool comprising:

an elongate shank having a first end and a second end;

a hand grip attached to said elongate shank;

a loop portion attached to said first end of said elongate shank, said loop portion lying in a first plane and defining a central opening, said loop portion having an inner surface that extends about said central opening and which comprises a series of substantially flat portions for contacting corresponding flat surfaces of a shut-off valve;

a hook portion attached to said second end of said elongate shank, said hook portion extending to a beveled tip and lying in said first plane; and a protruding member attached to a portion of said hook portion that is between said beveled tip and said second end of said elongate shank, said protruding member extending in a direction that is generally orthogonal to said first plane, said protruding member having a substantially flat top and bottom surfaces and beveled corners.

* * * * *